United States Patent [19]

Sugiura et al.

[11] 4,455,080

[45] Jun. 19, 1984

[54] COPYING APPARATUS EQUIPPED WITH CONTROL DEVICE

[75] Inventors: Masamichi Sugiura, Toyokawa; Tsuneo Kitagawa, Toyohashi; Keiji Yoshida, Toyokawa, all of Japan

[73] Assignee: Minolta Camera Kabushiki Kaisha, Osaka, Japan

[21] Appl. No.: 315,649

[22] Filed: Oct. 27, 1981

[30] Foreign Application Priority Data

| | | | |
|---|---|---|---|
| Nov. 4, 1980 | [JP] | Japan | 55-155605 |
| May 14, 1981 | [JP] | Japan | 56-73034 |
| Oct. 13, 1981 | [JP] | Japan | 56-163766 |

[51] Int. Cl.[3] ..... G03G 15/00

[52] U.S. Cl. ..... 355/14 SH; 355/3 SH

[58] Field of Search ..... 355/14 SH, 3 SH, 3 R, 355/14 R, 14 C; 271/225, 226, 227

[56] References Cited

U.S. PATENT DOCUMENTS

| | | | |
|---|---|---|---|
| 3,754,826 | 8/1973 | Kobayashi et al. | 271/226 X |
| 3,817,515 | 6/1974 | Kanda | 271/227 X |
| 4,134,672 | 1/1979 | Rhodes, Jr. | 355/3 SH |
| 4,212,457 | 7/1980 | Guenther | 355/14 SH X |
| 4,275,968 | 6/1981 | Irwin | 355/14 SH X |
| 4,310,236 | 1/1982 | Connin | 355/14 SH |
| 4,365,887 | 12/1982 | Kakitani et al. | 355/14 R |

*Primary Examiner*—A. C. Prescott

*Attorney, Agent, or Firm*—Wenderoth, Lind & Ponack

[57] ABSTRACT

A copying apparatus equipped with an improved control device for controlling a copying operation, and including a device for generating a start signal for starting the copying operation, a paper feeding device for starting feeding of copy paper sheets in response to the starting of the copying operation. The control device comprises a device for generating a stop signal for stopping the copying operation and a device for preventing starting of operation of at least the paper feeding device when the stop signal is generated after the start signal has been generated and before the paper feeding device is operated.

8 Claims, 9 Drawing Figures

COPYING APPARATUS EQUIPPED WITH CONTROL DEVICE

BACKGROUND OF THE INVENTION

The present invention generally relates to copying apparatuses and more particularly, to a copying apparatus equipped with an improved control device, and arranged to function in a multi-copy mode in which a copying operation is repeated to produce a plurality of copies, with copy paper sheets automatically fed one at a time.

Generally, in conventional copying apparatuses having various functions of copying through a wide selection of the numbers of copies to be made, sizes of copy paper sheets, etc., it has been so arranged that an operator selects each function prior to starting of copying and then turns ON a print key for starting copying.

Although the known copying apparatuses of the above described type have a function of interrupt copying so as to interrupt the copying operation in the multi-copy mode so that a different copying operation may be performed, there has been such a disadvantage that since the copying apparatuses are incapable of receiving an interrupt signal until one cycle of the copying operation is completed once the copying operation has been started, at least one cycle of the copying operation is undesirably carried out.

Accordingly, in the conventional copying apparatuses, there has been such an inconvenience that undesirable waiting time is required to effect the interrupt copying since the copying operation is performed in an initially selected mode even if an interrupt button for effecting the interrupt copying is turned ON immediately after copying based on initially selected functions is started.

Furthermore, the known copying apparatuses have such a disadvantage that, since the interrupt copying is not effected until at least one cycle of the copying operation is completed once the copying operation has been started, the operator has to sort at least one copy paper sheet copied in the multi-copy mode from copy paper sheets copied in the interrupt copying mode, which is extremely troublesome.

Moreover, the conventional copying apparatuses are also incapable of receiving a stop signal for stopping the copying operation in the multi-copy mode until one cycle of the copying operation is completed once the copying operation has been started, resulting in unnecessary copying.

Furthermore, in the conventional copying apparatus provided with a plug-in counter for recording the number of copying operations, there has been such a disadvantage that, when the plug-in counter is withdrawn from the copying apparatus housing immediately after the copying operation is started, the copying operation is carried out, but the counter does not perform the counting operation, making it impossible to accurately count the number of copying operations performed.

SUMMARY OF THE INVENTION

Accordingly, an essential object of the present invention is to provide a copying apparatus equipped with an improved control device, which has a function of receiving a stop signal for a predetermined time period immediately after starting of a copying operation so as to eliminate troublesome operations or unnecessary copying, with substantial elimination of the disadvantages inherent in conventional control devices of this kind.

Another important object of the present invention is to provide a copying apparatus of the above-described type which has a function of receiving the stop signal after starting of a copying operation and prior to starting of feeding of copy paper sheets so that the copying operation may be stopped even after the copying operation has been started.

Still another object of the present invention is to provide a copying apparatus of the above-described type in which, when a plug-in counter is withdrawn from a copying apparatus housing after the copying operation has been started, the count content of the plug-in counter is arranged to be selectively increased by one step and maintained as it is when the copying operation is continued and stopped, respectively.

A still further object of the present invention is to provide an improved control device of the above-described type which is simple in structure, highly reliable in actual use, and can be readily incorporated into copying apparatuses and the like in general at low cost.

In accomplishing these and other objects according to one preferred embodiment of the present invention, there is provided a copying apparatus equipped with an improved control device for controlling a copying operation, and including means for generating a start signal for starting the copying operation and a paper feeding means for starting feeding of copy paper sheets in response to the starting of the copying operation. The control device comprises means for generating a stop signal for stopping the copying operation and means for preventing starting of operation of at least the paper feeding means when the stop signal is generated after the stop signal has been generated and before said paper feeding means is operated.

In accordance with the present invention, the copying apparatus is capable of receiving a stop signal after starting of a copying operation and prior to starting of feeding of copy paper sheets so as to stop the copying operation even after the copying operation has been started, thus eliminating troublesome operations and unnecessary copying.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
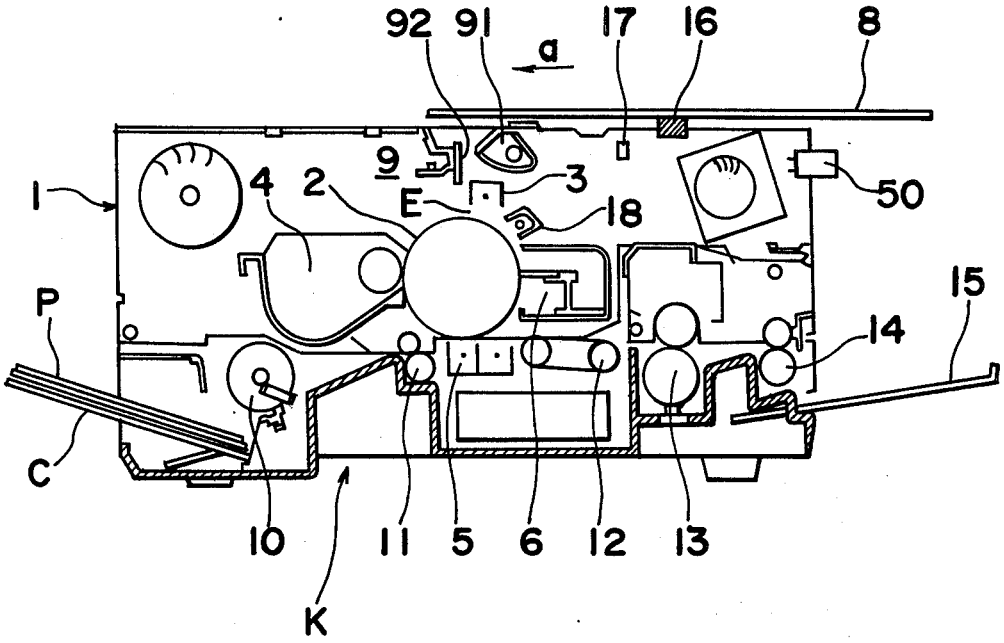
FIG. 1 is a schematic side sectional view of a copying apparatus to which a control device directly related to the present invention may be applied.

Referring now to the drawings, there is shown in FIG. 1, an electrophotographic copying apparatus K provided with a movable original supporting platform 8 to which a control device according to the present invention may be applied. The electrophotographic copying apparatus K is of a type having a multi-copy mode in which a copying operation is repeated to produce a plurality of copies with copy paper sheets P automatically fed one at a time. The electrophotographic copying apparatus K includes a photoreceptor drum 2 which is rotatably mounted approximately at a central portion of an apparatus housing 1 for rotation in the counterclockwise direction, and around which a corona charger 3, a developing device 4, a transfer charger 5, a charge eraser, a cleaning device 6, an eraser lamp 18, etc. are sequentially disposed along the circumference of the photoreceptor drum 2 in a known manner so as to process the surface of the photoreceptor drum 2 as the photoreceptor drum 2 rotates. The original platform 8 is reciprocatingly provided above and adjacent to the upper portion of the apparatus housing 1. The original platform 8 is moved from scanning in the direction indicated by an arrow a from a starting position shown in FIG. 1 with an original (not shown) to be copied being placed on a transparent plate (not shown) provided on the original supporting platform 8 and an image of the original is projected onto an exposure portion E of the surface of the photoreceptor drum 2 through an optical system 9 including an exposure lamp 91, an image transmitter formed of a plurality of graded index fibers in bundled configuration, etc. which is disposed below the original supporting platform 8. Copy paper sheets P are stacked in a cassette C disposed at a lower left portion of the apparatus housing 1 and are fed towards a pair of timing rollers 11 one sheet by one sheet through rotation of a paper feeding roller 10 rotatably provided in contact with the leading edge of the uppermost sheet of the stack of the copy paper sheets P. The copy paper sheet P is brought to a halt temporarily at the timing rollers 11 and is further fed, through rotation of the timing rollers 11 in synchronization with the rotation of the photoreceptor drum 2, to the transfer charger 5 where the powder image on the photoreceptor drum 2 is transferred onto the copy paper sheet P by the action of the transfer charger 5. The copy paper sheet P bearing the transferred powder image is separated from the photoreceptor drum 2 by the action of the charge eraser and then, is passed by means of a transport belt 12 through a fixing device 13, whereat the powder image on the copy paper sheet P is fixed by the application of heat. The copy paper sheet P having the fixed image thereon is finally ejected, through a pair of outlet rollers 14 provided at a lower right portion of the apparatus housing 1, onto a copy receiving tray 15 projecting out of the apparatus housing 1.

A magnet 16 provided on the undersurface approximately at a central portion of the original supporting platform 8 actuates a reed switch 17 disposed at an upper portion of the apparatus housing 1 when the original supporting platform 8 is moved to a predetermined position from the starting position shown in FIG. 1, whereby a signal for starting feeding of the copy paper sheets P is generated.

Furthermore, a plug-in counter 50 for counting the number of copying operations is detachably mounted at an upper right portion of the apparatus housing 1 and is arranged to enable starting of a copying operation when the plug-in counter 50 is mounted on the apparatus housing 1.

Figure 2:
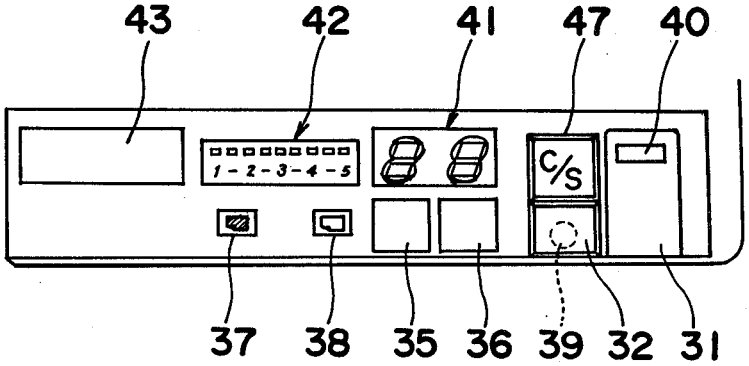
FIG. 2 is a front elevational view showing, on an enlarged scale, an operating panel employed in the copying apparatus of FIG. 1.

Referring to FIG. 2, an operating panel employed in the copying apparatus K is provided with a print key 31 for starting of a copying operation, an interrupt key 32 for stopping the copying operation in the multi-copy mode temporarily so as to effect other copying during the copying operation in the multi-copy mode, a light emitting device 39 which is turned ON when the copying apparatus K is set to the interrupt mode, numeral keys 35 and 36 for setting the number of copies to be taken which is displayed in an indicator 41, keys 37 and 38 for, respectively, increasing and decreasing the amount of exposure displayed by an exposure amount indicator 42, an indicator portion 43 including a jam indicator for indicating jamming of copy paper sheets P, an empty copy paper indicator, etc. and a clear/stop key 47 (referred to as a stop key, hereinbelow) for causing the indicator 41 to display "1" when the copying operation is being stopped and for stopping the copying operation with the numeral displayed by the indicator 41 being maintained as it is when the copying operation in the multi-copy mode is being performed.

Figure 3:
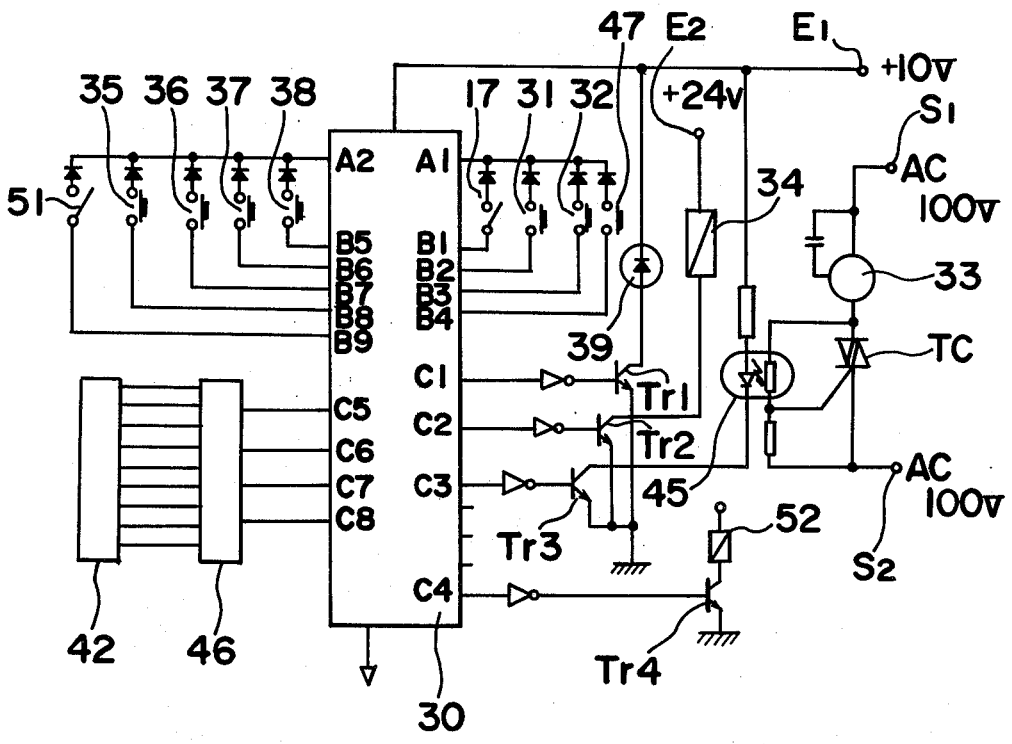
FIG. 3 is an electrical circuit diagram showing a microcomputer and input keys connected thereto which are employed in the copying apparatus of FIG. 1, FIGS. 4(*a*) to 4(*e*) are flow charts showing processing sequences of operational control of the copying apparatus by the microcomputer of FIG. 3.

The above-described various input keys such as the print key 31, interrupt key 32, stop key 47, etc. and various indicators together with the reed switch 17 and other devices provided in the copying apparatus K are connected with a microcomputer 30 so that the microcomputer 30 may control the copying operations in accordance with conditions determined by various input keys, as shown in FIG. 3.

Referring now to FIG. 3, there is shown a control circuit in which the copying operations are controlled by the control device of the present invention through the use of the microcomputer 30. The control circuit includes the reed switch 17, print key 31, interrupt key 32, numeral keys 35 and 36, keys 37 and 38, light emitting device 39, transistors Tr1, Tr2, Tr3 and Tr4, exposure amount indicator 42, stop key 47, a main motor 33, a clutch mechanism 34 for reciprocating the original platform 8, a photo coupler 45, a triac TC, a driver circuit 46 for the exposure amount indicator 42, a plug-in counter detection switch 51, and a solenoid 52 for actuating the plug-in counter 50, all of which are connected to the microcomputer 30. The microcomputer 30 includes input ports A1 and A2, and output ports B1, B2, B3, B4, B5, B6, B7, B8, B9, C1, C2, C3, C4, C5, C6, C7, and C8. The input port A1 is connected to the output port B1 through the reed switch 17, to the output port B2 through the print key 31, to the output port B3 through the interrupt key 32, and to the output port B4 through the stop key 47. The input port A2 is connected to the output port B5 through the key 38, to the output port B6 through the key 37, to the output port B7 through the numeral key 36, to the output port B8 through the numeral key 35, and to the output port B9 through the plug-in counter detection switch 51.

The output port C1 is connected, through the transistor Tr1, to the light emitting device 39 which is connected to the junction of a power source E1 and the microcomputer 30. The output port C2 is connected, through the transistor Tr2, to the clutch mechanism 34 leading to a power source E2. The output port C3 is connected, through the transistor Tr3, photo coupler 45 and triac TC, to the main motor 33. The main motor 33 and triac TC are connected in series between a power source S1 and a power source S2. The output port C4 is connected to the solenoid 52 via the transistor Tr4. The output ports C5, C6, C7 and C8 are connected to the exposure amount indicator 42 by way of the driver circuit 46. The photo coupler 45 is turned ON by a control signal emitted from the output port C3 and thus, the triac TC is triggered so as to turn ON the main motor 33. The transistor Tr4 is turned ON by a control signal emitted from the output port C4 and thus, the solenoid 52 is turned ON, so that the count content of the plug-in counter 50 is increased by one upon turning off of the solenoid 52. Drive of the clutch mechanism 34 for reciprocating the original platform 8 is controlled by a control signal emitted from the output port C2. The plug-in counter detection switch 51 is provided so that the microcomputer 30 may decide whether or not the plug-in counter 50 is fitted into the apparatus housing 1. When the plug-in counter 50 is fitted into the apparatus housing 1, the switch 51 is closed.

Figure 4A:
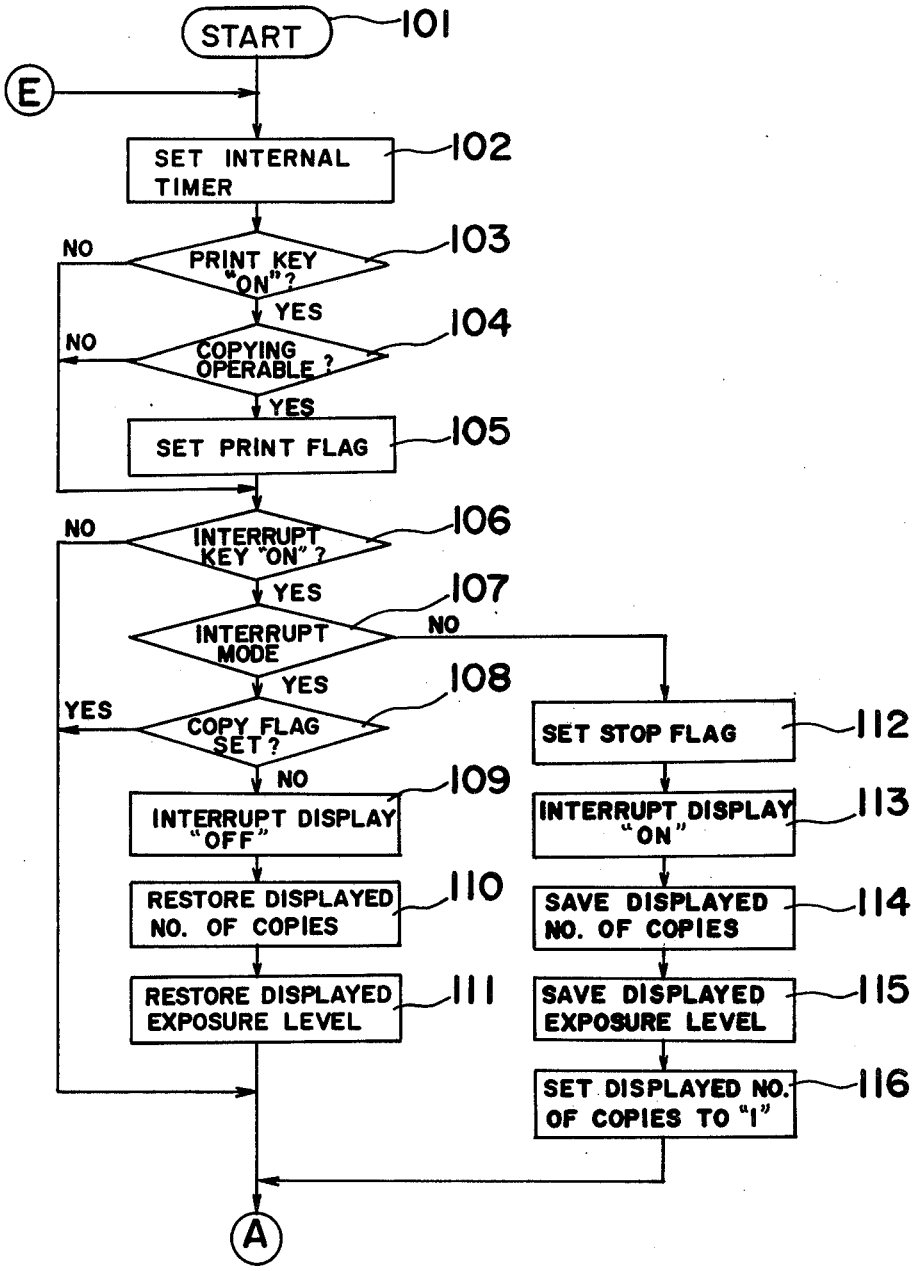
Figure 4:
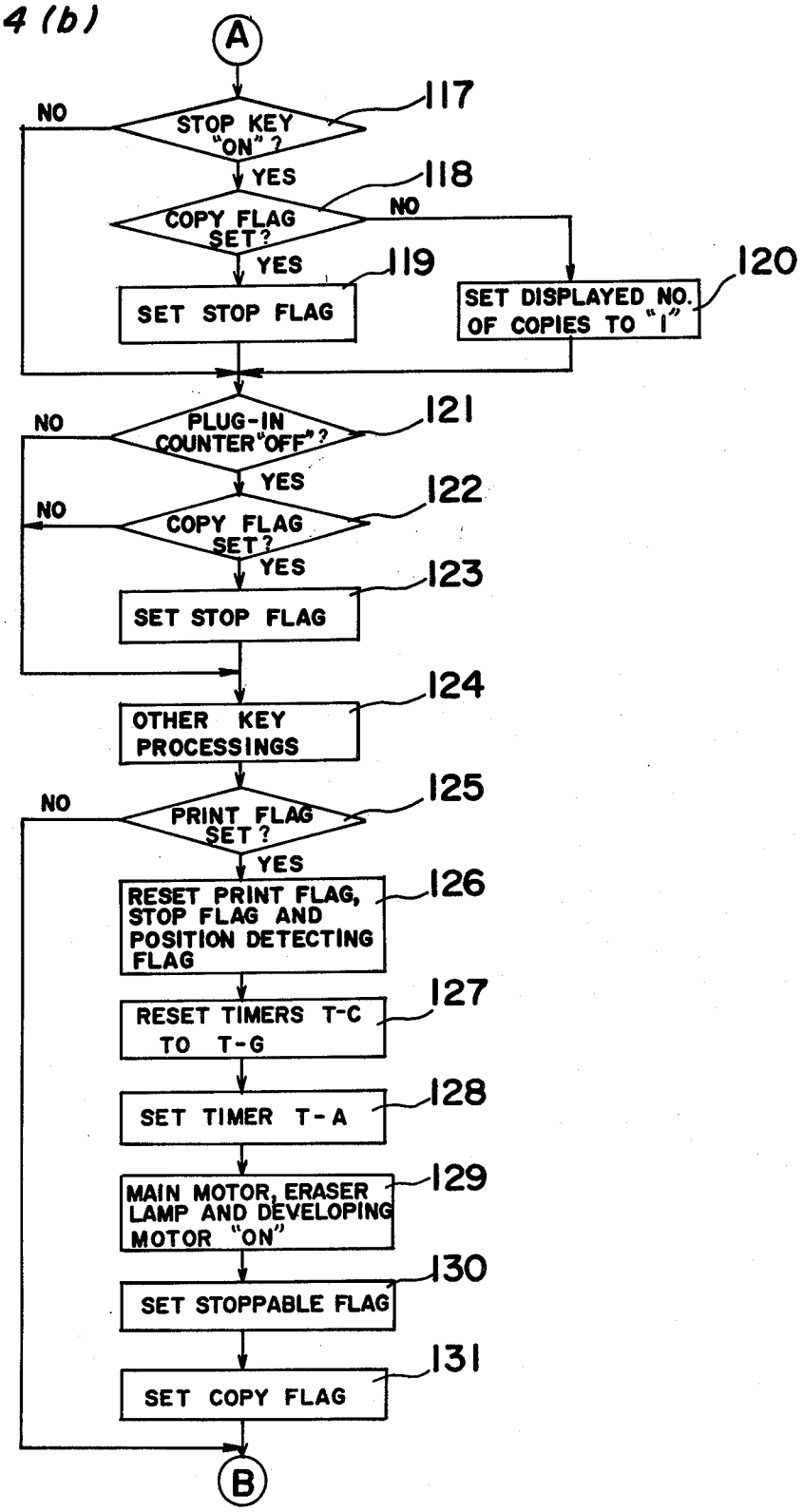
Figure 4C:
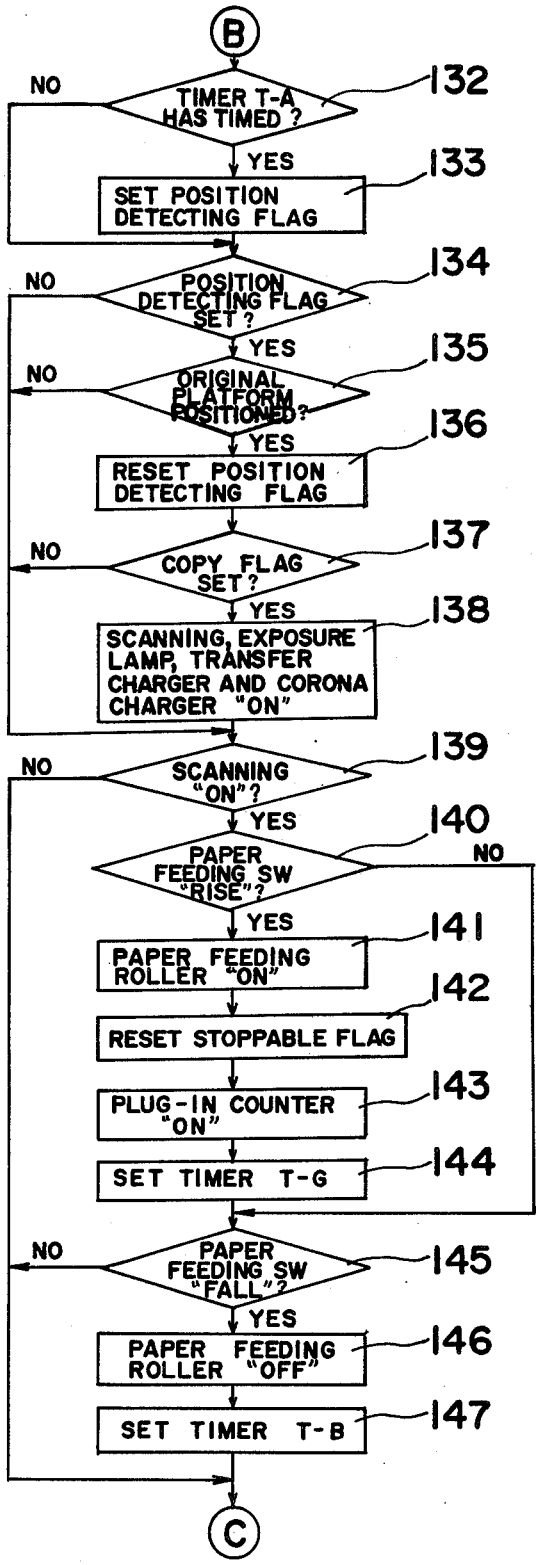
Figure 4D:
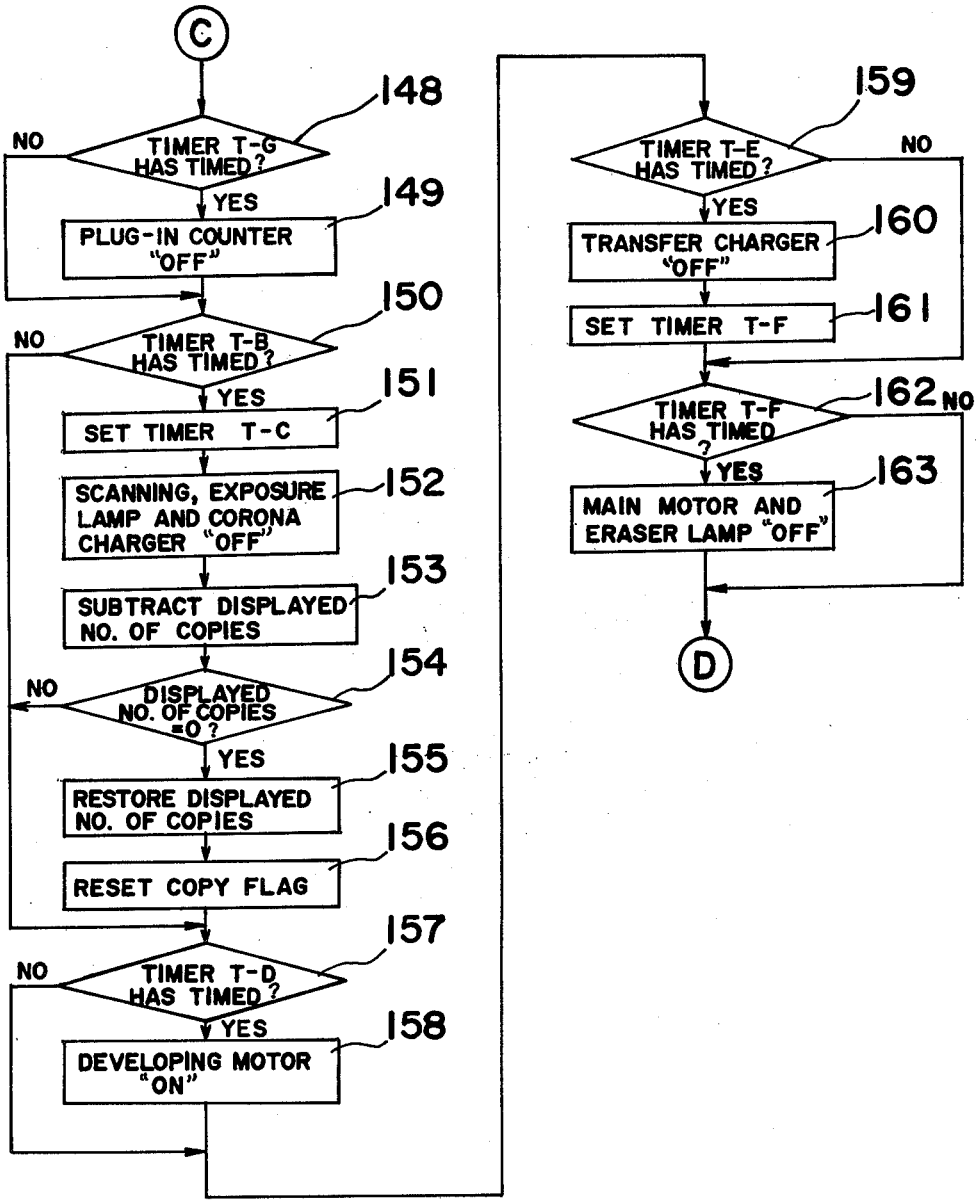
Figure 4:
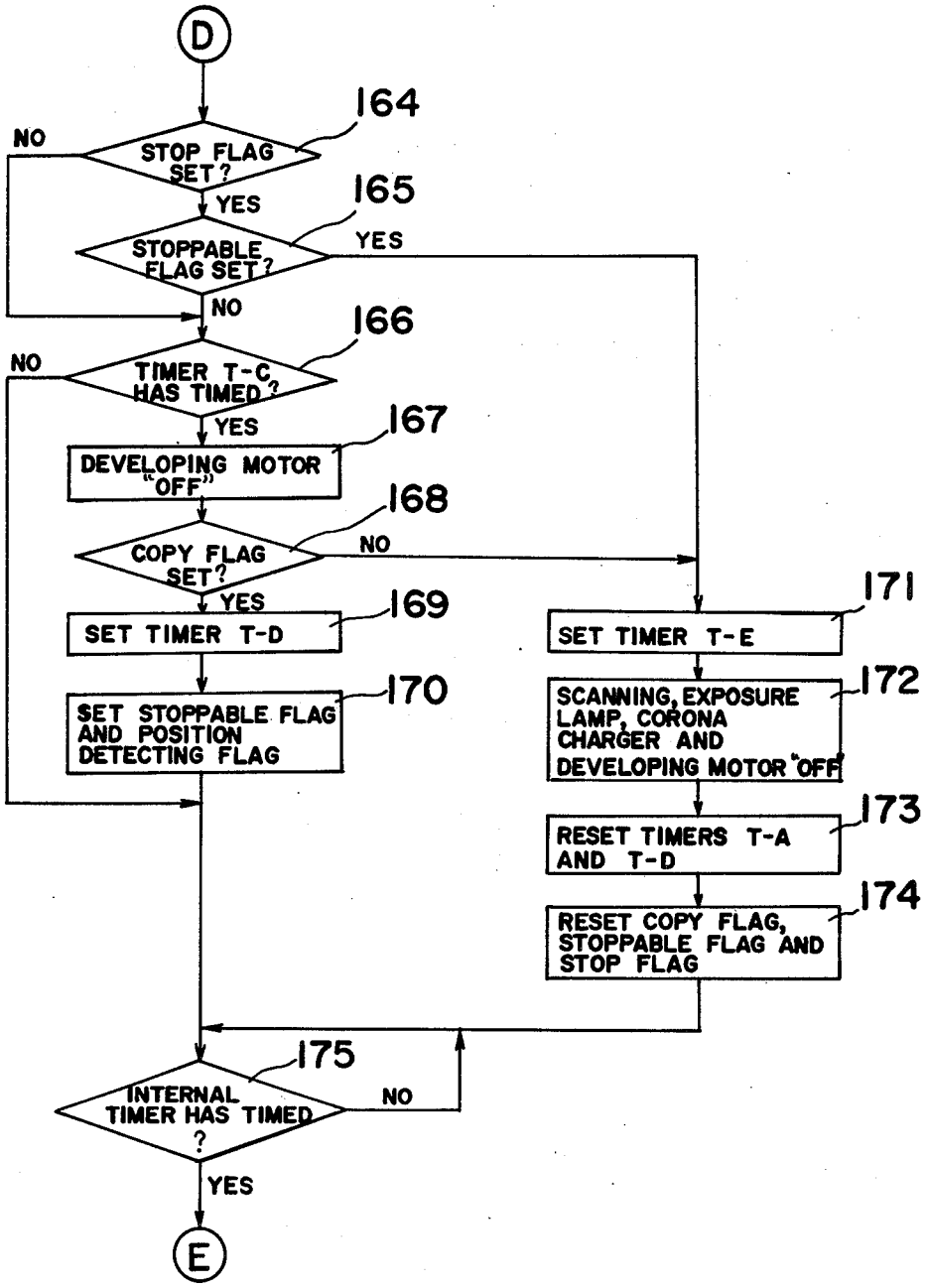

Although the microcomputer 30 is further connected to the indicator 41, a driver circuit (not shown) for the indicator portion 43, a switch (not shown) for detecting a predetermined position for starting scanning movement of the original platform 8 and control circuits (not shown) for the corona charger 3, developing device 4, transfer charger 5, exposure lamp 91, eraser lamp 18, etc., of the above arrangement are according to the prior art and are not directly related to the present invention, so that their operations will be described in accordance with flow charts in FIGS. 4(*a*) to 4(*d*) but their description in connection with the microcomputer 30 is abbreviated here for brevity.

One example of the concrete processing sequence by the microcomputer 30 will be described in accordance with flow charts in FIGS. 4(*a*) to 4(*e*), with reference to a time chart in FIG. 5, hereinbelow.

Referring to FIG. 4(*a*), an internal timer t starts a timing operation at a step 102 following a step 101 for starting the program processing. The internal timer t has a preset time of approximately 10 to 15 msec. slightly larger than the maximum time which the microcomputer 30 requires to process the program. By the step 102, the processing time from the initial step 101 to a final step 175 is maintained constant irrespective of amount to be processed and present time of each of control timers T-A, T-B, T-C, T-D, T-E, T-F and T-G to be described later can be made accurate. The timers T-A to T-G complete the timing operation each time one routine of the program is executed. Meanwhile, the timer T-A sets a delay time between turning ON of the print key 31 and starting of scanning movement of the original platform 8. The timers T-B, T-C, T-D, T-E, and T-F measure predetermined time periods upon lapse of which the scanning movement of the original platform 8 is stopped, a developing motor (not shown) is turned OFF, the developing motor is turned ON in the multi-copy mode, the transfer charger is turned off of the case where the final copying operation is completed, and the main motor 33 is turned OFF, respectively. The timer T-G sets a time period during which the solenoid 52 for the plug-in counter 50 is being turned ON.

If it is found at a step 103 that the print key 31 is turned ON, a decision is made as to whether or not the copying apparatus K is in a state which enables starting of a copying operation at a step 104. The state which enables starting of a copying operation means, for example, that various devices in the apparatus housing 1 function normally, the fixing device 13 reaches a predetermined temperature, the plug-in counter 50 is properly fitted into the apparatus housing 1 and the copying operation is not performed, that is, a copy flag is reset. In the case of "YES" at the step 104, a print flag is set at a step 105. In the case of "NO", a step 106 follows.

The following steps 106 to 116 indicate the processing in the case where the interrupt key 32 is turned ON. If it is found at the step 106 that the interrupt key 32 is turned ON, a decision is made as to whether or not the copying apparatus K is in the interrupt mode at the step 107. In the case of "YES", processing for reinstating the copying apparatus K to the normal mode is executed in the steps 108 to 111. In the case of "NO", that is, the interrupt key 32 is turned ON in the normal mode, the copying apparatus K is set to the interrupt mode in the steps 112 to 116. Namely, a stop flag is set at the step 112, the light emitting device 39 for indicating the interrupt mode is turned ON at the step 113, the numeral displayed in the normal mode by the indicator 41 for indicating the number of copies to be taken is saved in a memory (not shown) of the microcomputer 30 at the step 114, the amount of exposure displayed in the normal mode by the exposure amount indicator 42 is saved in the memory of the microcomputer 30 at the step 115 and the numeral displayed by the indicator 41 for indicating the number of copies to be taken is set to "1" at the step 116 followed by a step 117 in FIG. 4(*b*).

On the contrary, in the case of "YES" at the step 107, a decision is made as to whether or not the copy flag is set at the step 108. In the case of "YES", the step 117 follows. In the case of "NO", the light emitting device 39 for indicating the interrupt mode is turned OFF at the step 109, the numeral which was displayed in the normal mode by the indicator 41 and was saved in the memory of the microcomputer 30 is restored at the step 110 and the amount of exposure which was displayed in the normal mode by the exposure amount indicator 42 and was saved in the memory of the microcomputer 30 is restored at the step 111 followed by the step 117.

When the copying apparatus K is set to the interrupt mode, the stop flag is set at the step 112 as described above. The step 112 is related to steps 165 and 172 in FIG. 4(*e*) to be described later. If it is found at the step 165 that the interrupt key 32 is turned ON under conditions that operations of the copying apparatus K can be stopped, the scanning movement of the original platform 8 is stopped, and the exposure lamp 91, corona charger 3 and developing motor are turned OFF at the step 172. The above-described stoppable conditions of operations of the copying apparatus K will be described later.

Referring now to FIG. 4(*b*), processing for the stop key 47 is executed at steps 117 to 120. If it is found at the step 117 that the stop key 47 is turned ON, a decision is made as to whether or not the copy flag is set at the step 118. In the case of "NO", that is, the copy flag is reset, the numeral displayed by the indicator 41 for indicating the number of copies to be taken is set to "1" at the step 120 followed by a step 121. In the case of "YES", that is, the copying operation is being performed, the stop flag is set at the step 119 followed by the step 121. It should be noted that processing after the stop flag is set, is the same as in the case of the above-described interrupt key 32. Namely, the step 119 is related to the steps 165 and 172.

The steps 121 to 123 indicate processing in connection with withdrawal of the plug-in counter 50 from the apparatus housing 1. Namely, if it is found at the step 121 that the plug-in counter 50 is withdrawn from the apparatus housing 1, a decision is made as to whether or not the copy flag is set at the step 122. In the case of "NO", a step 124 follows. In the case of "YES", the stop flag is set at the step 123 followed by the step 124. It should be noted that processing after the stop flag is set is the same as in the case of the abovedescribed interrupt key 32 and stop key 47.

At the step 124, processing in response to input of keys such as the numeral keys 35 and 36, exposure amount keys 37 and 38, etc. is executed.

Then, if it is found at a step 125, that the print flag is set, the print flag, stop flag and a flag for detecting a predetermined position for starting scanning movement of the original platform 8 (hereinbelow, referred to as "a predetermined position detecting flag") are reset at a step 126, the timers T-C, T-D, T-E, T-F and T-G (refer to FIG. 5) are reset at a step 127, the timer A for setting a delay time between turning ON of the pring key 31 and starting of scanning movement of the original platform 8 (refer to FIG. 5) is reset at a step 128, the main motor 33, eraser lamp 18, developing motor, etc. are turned ON at a step 129, a flag for indicating that operations of the copying apparatus K can be stopped (hereinbelow, referred to as "a stoppable flag") is set at a step 130, and the copy flag for indicating that a copying operation is being performed is set at a step 131.

It is to be noted that the print key 31 can be turned ON after scanning movement of the original platform 8 for the final copying operation has been completed.

Referring now to FIG. 4(*c*), if it is found at a step 132 that the preset time of the timer T-A has elapsed, the predetermined position detecting flag is set at a step 133 followed by a step 134. If it is found at the step 134, that the predetermined position detecting flag is set, a decision is made as to whether or not the original platform 8 is located at the predetermined position for starting scanning movement at a step 135.

It should be noted that, in the case where the copying operation is being performed in the multi-copy mode, the predetermined position detecting flag is set after the developing motor has been turned OFF, as shown by a step 170 in FIG. 4(*e*).

In the case of "NO" at the step 135, a step 139 follows. In the case of "YES" at the step 135, the predetermined position detecting flag is reset at a step 136 followed by a step 137. If it is found at the step 137 that the copy flag is set, scanning movement of the original platform 8 is started, and the exposure lamp 91, corona charger 3 and transfer charger 5 are turned ON at a step 138 followed by a step 139. Since there is a case in which a stop signal or an interrupt signal, etc. for stopping the copying operation in the multi-copy mode is received by the copying apparatus K in the multi-copy mode after the developing motor has been turned OFF and thus, the copy flag is reset, the step 137 is provided for deciding as to whether or not the scanning movement of the original platform 8 should be started when the original platform 8 is returned to the predetermined position.

If it is found at the step 139 that the scanning movement of the original platform 8 is started, a decision is made as to whether or not a signal generated by the paper feeding switch 17 rises in response to the turning ON at a step 140. In the case of "NO", a step 145 follows. In the case of "YES", the paper feeding roller 10 is turned ON at a step 141, the stoppable flag is reset at a step 142, a signal for turning ON the solenoid 52 for the plug-in counter 50 is transmitted to the solenoid 52 at a step 143, and the timer T-G for setting a time period during which the solenoid 52 is being turned ON starts the timing operation at a step 144 followed by the step 145.

Figure 5:
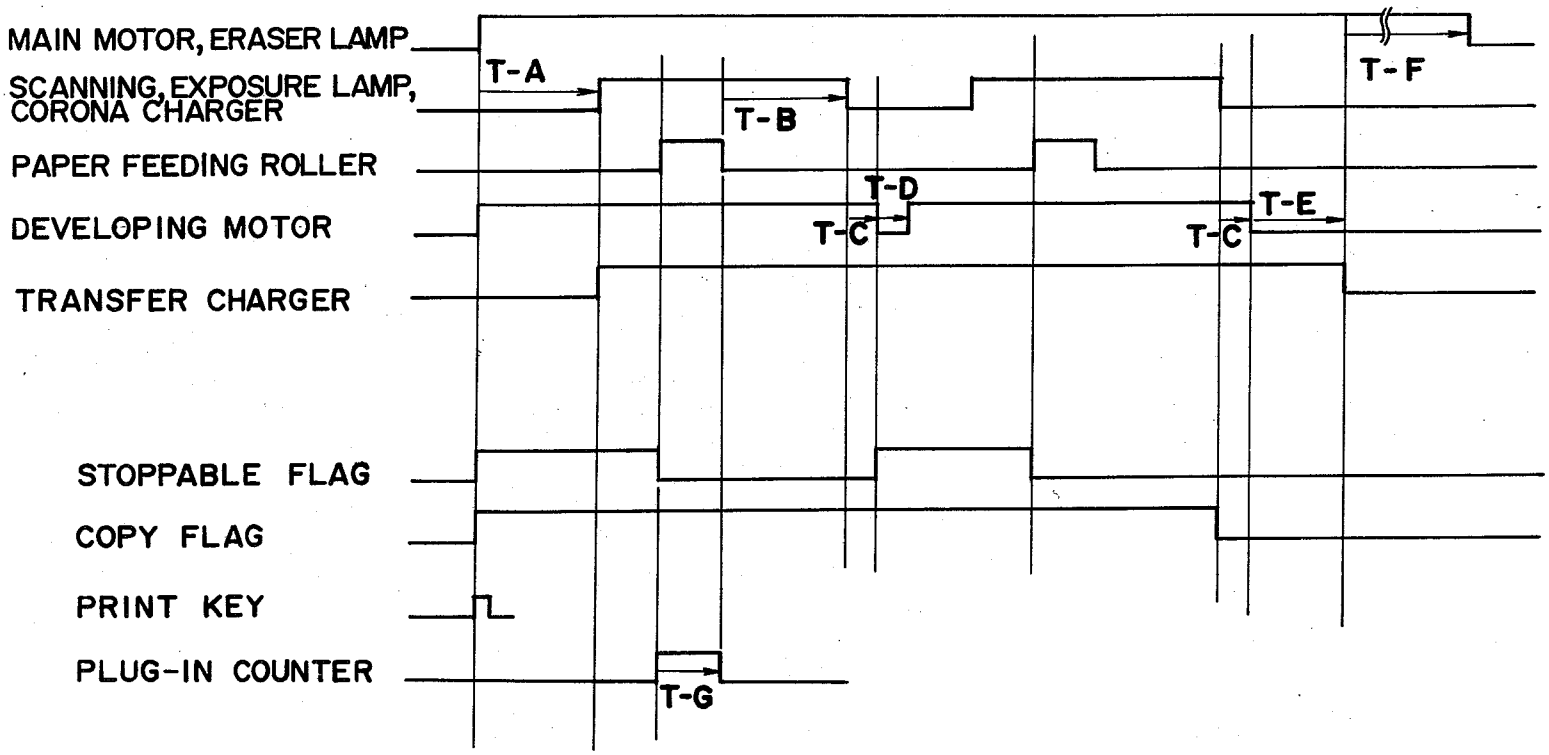
FIG. 5 is a time chart for explaining the relation between operations of the copying apparatus of FIG. 1 and their timing.

Namely, the stoppable flag at the time of starting of the copying operation is set during a time period from turning ON of the print key 31 to turning ON of the paper feeding roller 10 as shown in FIG. 5.

If it is found at the step 145, that the signal generated by the paper feeding switch 17 falls in response to its turning OFF, the paper feeding roller is turned OFF and processing including turning ON of the timing rollers 11, etc. is executed at a step 146, and the timer T-B starts timing operation at a step 147. The timer T-B measures a predetermined time period upon the lapse of which the scanning movement of the original platform 8 is stopped.

Meanwhile, it should be noted that a time period during which the paper feeding roller 10 is driven is determined by a length of the magnet 16 for actuating the switch 17.

Referring now to FIG. 4(*d*), if it is found at a step 148 that the preset time of the timer T-G has elapsed, the solenoid 52 for the plug-in counter 50 is turned OFF at a step 149 followed by a step 150.

If it is found at the step 150, that the preset time of the timer T-B has elapsed, the timer T-C starts timing operation at a step 151 followed by a step 152. The timer T-C measures a predetermined time period upon lapse of which the developing motor is turned OFF.

At the step 152, the scanning movement of the original platform 8 is stopped and the exposure lamp 91, and corona charger 3 are turned OFF. Then, the numeral displayed by the indicator 41 for indicating the number of copies to be taken is subtracted by one at a step 153 followed by the step 154.

If it is found at the step 154 that the numeral displayed by the indicator 41 is "0", the numeral displayed by the indicator 41 is restored to the original setting value at a step 155 and the copy flag is reset at a step 156 followed by a step 157.

If it is found at the step 157 that the preset time of the timer T-D has elapsed, the developing motor is turned ON at a step 158 followed by a step 159. The timer T-D measures a predetermined time period upon the lapse of which the developing motor is turned ON in the multi-copy mode and starts timing operation at a step 169 in FIG. 4(*e*), as shown in FIG. 5.

If it is found at the step 159 that the preset time of the timer T-E has elapsed, the transfer charger 5 is turned OFF at a step 160 and the automatic shut timer T-F starts timing operation at a step 161 followed by a step 162. The timer T-E starts timing operation in a step 171 in FIG. 4(*e*) when the developing motor is turned OFF at the time of the final copying operation or the stop signal is received by the copying apparatus K, and measures a predetermined time period upon the lapse of which the transfer charger 5 is turned OFF in the case where the final copying operation is completed.

Meanwhile, the automatic shut timer T-F starts timing operation upon lapse of the preset time of the timer T-E and measures a predetermined time period upon lapse of which the main motor 33 is turned OFF. Accordingly, the main motor 33 is turned OFF so that the photoreceptor drum 2 may be rotated with the eraser lamp 18 being turned ON for the predetermined time period after the final copying operation has been completed.

If it is found at the step 162 that the preset time of the timer T-F has elapsed, the main motor 33 and eraser lamp 18 are turned OFF so as to stop the operation of the copying apparatus K at a step 163.

Referring now to FIG. 4(*e*), if it is found at a step 164 that the stop flag is set, a decision is made as to whether or not the stoppable flag is set at a step 165. Namely, at the steps 164 and 165, when the stop flag has been set upon turning ON of the interrupt key 32 or the stop key 47 or withdrawal of the plug-in counter 50 from the apparatus housing 1, a decision is made as to whether or not the copying apparatus K is in a state capable of receiving the stop signal. As is clear from FIG. 5, the stoppable flag is set for a time period from turning ON of the print key 31 to turning ON of the paper feeding roller 10 and for another time period from turning OFF of the developing motor during one cycle of the copying operation (steps 167 to 170) to turning ON of the paper feeding roller 10 during the next cycle of the copying operation.

In the case of "YES" at the step 165, the timer T-E starts timing operation at a step 171, the scanning movement of the original platform 8 is stopped, the exposure lamp 91, corona charger 3 and developing motor are turned OFF, and the original platform 8 is returned to the predetermined position for starting the scanning movement at a step 172, the timers T-A and T-D are reset at a step 173, and the copy flag, stoppable flag and stop flag are reset at a step 174 followed by a step 175. It is to be noted that, when the stoppable flag is reset even if the stop flag has been set, the stop signal cannot be received by the copying apparatus K, so that at least one cycle of the copying operation is carried out. Even if the plug-in counter 50 is withdrawn from the apparatus housing 1 in this case, the count content of the plug-in counter has been increased by one so as to give the accurate number of copies made.

On the contrary, in the case of "NO" at the step 165, a decision is made as to whether or not the preset time of the timer T-C has elapsed. In the case of "NO", the step 175 follows. In the case of "YES", the developing motor is turned OFF at the step 167 followed by a step 168.

If it is found at the step 168 that the copy flag is set, that is, the copying operation in the multi-copy mode is continued, the timer T-D starts timing operation at a step 169, and the stoppable flag and predetermined position detecting flag are set at a step 170 followed by the step 175. The scanning movement of the original platform 8 is stated, etc. upon returning of the original platform 8 to the predetermined position in the steps 134 to 138 as described above. Meanwhile, the timer T-D measures a predetermined time period upon lapse of which the developing motor is turned ON in the next cycle of the copying operation.

If it is found at the step 175 that the preset time of the internal timer t has elapsed, the step 102 follows to loop the program. The step 175 is provided for obtaining a constant processing time for one routine of the program as described above.

Meanwhile, as described above the numeral displayed by the indicator 41 for indicating the number of copies to be taken is substracted by one at the step 153 upon lapse of the preset time of the timer T-B at the step 150, but processing of the step 153 at the time of change-over of the normal mode and interrupt mode will be further described, hereinbelow. Since the step 108 is provided in the case where the copying operation in the interrupt mode is being performed, the processing of the steps 109 to 111 for cancelling the interrupt mode is not executed when the copy flag is set (the copying operation is being carried out) even if the interrupt key 32 is turned ON at the step 106, so that the numeral which is being displayed by the indicator 41 is subtracted by one at the step 153.

On the contrary, in the case where the copying operation in the normal mode is being performed, processing of the steps 112 to 116 upon turning ON of the interrupt key 32 at the step 106 is executed even when the original platform 8 is being moved for scanning and furthermore, one cycle of the copying operation in the normal mode is carried out unless the copying apparatus is in the stoppable state, so that the numeral which was displayed in the normal mode by the indicator 41 and was saved in the memory of the micro-computer 30 at the step 114 is subtracted by one at the step 153 upon lapse of the preset time of the timer T-B at the step 150.

Meanwhile, in the above-described embodiment, the copying apparatus K is of such a type that the original platform 8 is moved for scanning and that the switch 17 is turned ON during the scanning movement of the original platform 8 so as to start feeding of the copy paper sheets P. However, it is to be noted that the control device of the present invention can be further applied to a copying apparatus of such a type that the optical system is moved for scanning or one of such a type that a signal for starting feeding of copy paper sheets is generated in response to rotation of the photoreceptor drum.

In accordance with the present invention, when an interrupt key or a stop key is turned ON or a plug-in counter is withdrawn from a copying apparatus housing after turning ON of a print key and prior to starting of feeding of copy paper sheets, the copying operation is stopped immediately so that the copying apparatus may be reinstated to conditions enabling another copying operation, so that the copying operation can be interrupted or stopped even after turning ON of the print key, whereby undesirable waiting time and unnecessary copying have been eliminated with obviation of an inconvenience that a plug-in counter does not perform a counting operation although the copying operation has been carried out.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A copying apparatus including means for generating a start signal for starting a copying operation, a movable member which is caused to start moving in response to the starting of the copying operation, a paper feeding means for starting feeding of copy paper sheets, a switch means actuated by said movable member during the movement of said movable member, said paper feeding means being actuated in response to actuation of said switch means, and a control device for controlling the copying operation, said control device comprising:

means for generating a stop signal for stopping the copying operation;

means for preventing starting of operation of at least said paper feeding means when said stop signal is generated after said start signal has been generated and before said paper feeding means is operated; and means for causing said movable means to be returned to a starting position when the starting of the operation of said paper feeding means has been prevented in response to the generation of said stop signal.

2. A copying apparatus as claimed in claim 1 which is a type having a multi-copy mode in which a copying operation is repeated to produce a plurality of copies with copy paper sheets automatically fed one at a time, and further including a stop key for interrupting the copying operation in the multi-copy mode, said stop key being said means for generating said stop signal.

3. A copying apparatus as claimed in claim 2, further including a display means for indicating the number of copying operations which have been performed, said control device including means for selectively stopping the copying operation without changing the number indicated by said display means and setting the number indicated by said display means to "1", upon turning ON of said stop key, when the copying operation in the multi-copy mode is being performed and is not being performed, respectively.

4. A copying apparatus as claimed in claim 1 which is a type having a multi-copy mode in which a copying operation is repeated to produce a plurality of copies with copy paper sheets automatically fed one at a time, and further including an interrupt key turnable to an ON position for interrupting the copying operation in the multi-copy mode so that other copying operation may be performed, said interrupt key being said means for generating said stop signal when said interrupt key is turned to said ON position.

5. A copying apparatus as claimed in claim 4, further including a display means for indicating the number of copying operations which have been performed and a memory means for storing the number therein, said control device including means for causing said memory means to store therein the number indicated by said display means so that the copying operation in the multi-copy mode may be stopped when said interrupt key has been turned ON during the copying operation in the multi-copy mode.

6. A copying apparatus as claimed in claim 1, further including a plug-in counter and said start signal generating means having a mechanism for generating the start signal so that the copying operation can be started upon fitting of said plug-in counter into a copying apparatus housing, said stop signal generating means including means for generating the stop signal when the plug-in counter is withdrawn from said copying apparatus housing during the copying operation.

7. A copying apparatus as claimed in claim 6, wherein said plug-in counter is actuated by a signal for actuating said paper feeding means.

8. A copying apparatus including means for generating a start signal for starting a copying operation, a plug-in counter, said start signal generating means generating the start signal in response to fitting of the plug-in counter into the copying apparatus, a paper feeding means for starting feeding of copy paper sheets in response to starting of the copying operation, and a control device for controlling the copying operation, said control device comprising: means for generating a stop signal upon withdrawal of said plug-in counter from the copying apparatus, and means for preventing starting of at least said paper feeding means when said stop signal is generated after said start signal has been generated and before said paper feeding means is operated.

* * * * *